United States Patent [19]

Attwood et al.

[11] 4,046,622

[45] Sept. 6, 1977

[54] MULTI-PLY FIBROUS SHEETS HAVING A WET-LAID PLY AND A DRY-LAID PLY

[75] Inventors: Brian William Attwood, Bristol; Dennis Raymond Hicklin, Bath, both of England

[73] Assignee: Karl Kroyer St. Anne's Limited, Bristol, England

[21] Appl. No.: 696,184

[22] Filed: June 15, 1976

Related U.S. Application Data

[63] Continuation of Ser. No. 485,266, July 2, 1974, abandoned.

[30] Foreign Application Priority Data

Aug. 23, 1973 United Kingdom ..... 40074/73

[51] Int. Cl.[2] ..... D21H 1/02; D21H 1/06

[52] U.S. Cl. ..... 162/132; 162/201; 162/303; 264/121

[58] Field of Search ..... 162/123, 125, 129, 133, 162/208, 299, 300, 304, 310, 357, 359, 361, 132, 303, 206, 290, 201; 264/121; 427/202, 206

[56] References Cited

U.S. PATENT DOCUMENTS

| | | | |
|---|---|---|---|
| 2,881,072 | 4/1959 | Clark | 162/201 X |
| 2,886,484 | 5/1959 | French et al. | 264/121 X |
| 3,816,159 | 6/1974 | Newman | 427/202 |
| 3,825,381 | 7/1974 | Dunning et al. | 162/290 X |
| 3,905,864 | 9/1975 | Curry et al. | 162/133 |
| 3,954,554 | 5/1976 | Curry et al. | 162/132 X |

*Primary Examiner*—S. Leon Bashore
*Assistant Examiner*—Richard V. Fisher
*Attorney, Agent, or Firm*—Larson, Taylor and Hinds

[57] ABSTRACT

A process and apparatus for forming a multi-ply sheet of cellulosic fibrous material. A dry-laid mat and a wet-laid web of cellulosic fibers are joined together and concurrently the dry-laid mat is consolidated by the concurrent application of heat, pressure and moisture, the moisture being derived from the wet-laid web.

7 Claims, 2 Drawing Figures

MULTI-PLY FIBROUS SHEETS HAVING A WET-LAID PLY AND A DRY-LAID PLY

Figure 1:
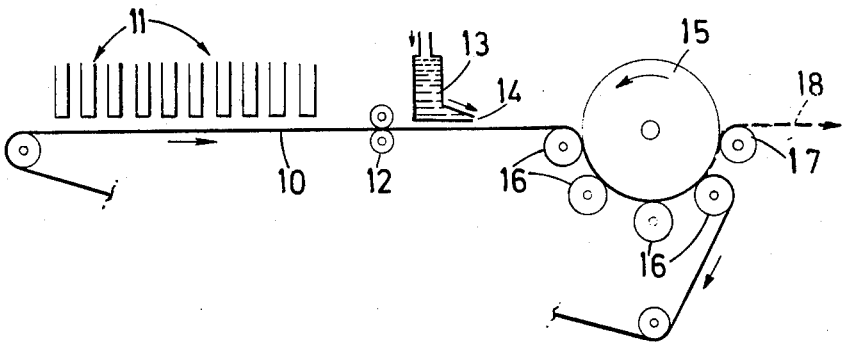

This is a continuation. of application Ser. No. 485,266 filed July 2, 1974 now abandoned.

This invention concerns a method of and apparatus for making multi-ply fibrous sheets and in particular is concerned with the manufacture of fibrous sheets using the so-called dry forming method in which fibres in a substantially dry state are formed into webs and are bound into a sheet using a binder or adhesive.

Where binders such as starch are used it is customary to employ some moisture to activate the starch and form an effective bond. Furthermore the addition of water enables one to develop strength by consolidating the sheet in a heated pressure nip.

The addition of the water to the dry formed web has been effected using water sprays. Even where these are mounted on a conveyor at move them across the formed web there is still a danger that should one spray become inoperative relatively dry spots or streaks will occur in the dry formed web end the resulting web will not be homogeneous and will have differing characteristics according to the amount of moisture present when the web is consolidated. Furthermore the maintenance problems associated with the sprays and the need for conveyors and the like to move the sprays is not attractive in continuously running machinery as used in the paper industry. It is an object of the present invention to avoid the use of sprays in applying water to dry formed webs.

According to the present invention, a process and apparatus for forming a multi-ply sheet of cellulosic fibrous material is provided wherein a dry-laid web of cellulosic fibers are provided to form a mat upon a main forming band while a web of cellulosic fibers are formed by a wet-forming technique on an auxiliary forming band. The fibrous mat and the wet-formed web are joined together and concurrently the fibrous is consolidated by subjecting it to heat, moisture and pressure, the moisture being derived by transfer thereof from the wet-laid web with which the mat is joined.

The aqueous sheet may for example be in the form of a film of water which is projected onto the upper surface of the fibrous mat. A problem does arise in this arrangement in that a very thin sheet of water needs to be provided and yet if it is too thin and breaks up, a discontinuous sheet will be provided across the width of the machine and the same problem will arise as with sprays. It is essential to ensure that a continuous and even application of water is achieved across the full width of the machine. In place of an aqueous film a curtain of water may fall onto the mat to provide the moisture.

In view of the difficulties in projecting water alone onto the sheet in sufficiently small quantities to provide the level of moisture required and yet sufficient to avoid the film breaking up, the process preferably uses an aqueous sheet consisting of a high consistency fibrous stock. Preferably such a stock is of the consistency of 10 - 15% solids but in view of the difficulty of achieving such a stock which will also provide a homogeneous fibrous mat when laid upon the wire it may well be necessary to employ a fibrous stock of say 3 or 4% consistency.

Preferably the stock is directed onto the fibrous mat from a slice.

Although water or fibrous stock may be used, the preferred embodiment comprises forming the fibrous stock into a web by a wet forming technique on an auxiliary forming band and subsequently transferring this to the fibrous mat as a wet formed web. The wet formed ply may have a consistency of the order of 15% solids. The conventional wet forming technique could involve for example a cylinder mould machine, a suction former, a pressure former or any other high consistency forming technique.

Where a wet laid web is employed to carry the water onto the dry-laid fibrous mat it is preferably arranged that the water content of the wet-laid web is sufficient to provide all the moisture required by the dry-laid fibres to achieve efficient consolidation at a subsequent consolidation device.

The use of a wet formed web has additional advantages. In particular one avoids the disturbance of the fibres in the dry laid mat. The use of water or stock as suggested above could damage the formation and the use of a wet formed web avoids the problem. Furthermore, by the use of a conventional wet making technique, strength can be developed in the ply provided by this wet-laid web since advantage can be taken of strength development by beating. Furthermore, all sizing and similar agents can be added at the beater stage to simplify the sizing and coating problems on the machine wire.

Preferably the wet-laid web forms the liner ply for the finished product and, having wet-laid characteristics and the stength associated therewith, it will also have desirable fold characteristics and other advantages of wet-laid webs. However, manufacture of the product will not have associated with it the drying problems and in particular the need for cumbersome equipment, since the moisture will be taken up by the dry fibres for the subsequent consolidation process.

By this arrangement there is provided a process for dry-laying fibres in which moisture is added to the fibres using a wet-laid web, thereby avoiding sprays and yet taking advantage of the characteristics of a wet-laid web to add the moisture.

According to another aspect of the present invention there is provided apparatus for forming a web of fibrous materials comprising a supporting surface, means for dry-laying a mat of fibres thereon, means for introducing an aqueous sheet onto a surface of the fibrous mat to wet it and means for consolidating the fibrous mat to form a web. Preferably the apparatus comprises a device for projecting a film or curtain of water onto the mat.

The apparatus may comprise a slice for projecting high consistency stock onto the mat.

The apparatus may include an auxiliary forming band a conventional wet forming device for forming a web thereon and means for transferring the wet formed web onto the fibrous mat.

The apparatus may include heated pressure nips for consolidating the moistened mat.

Figure 2:
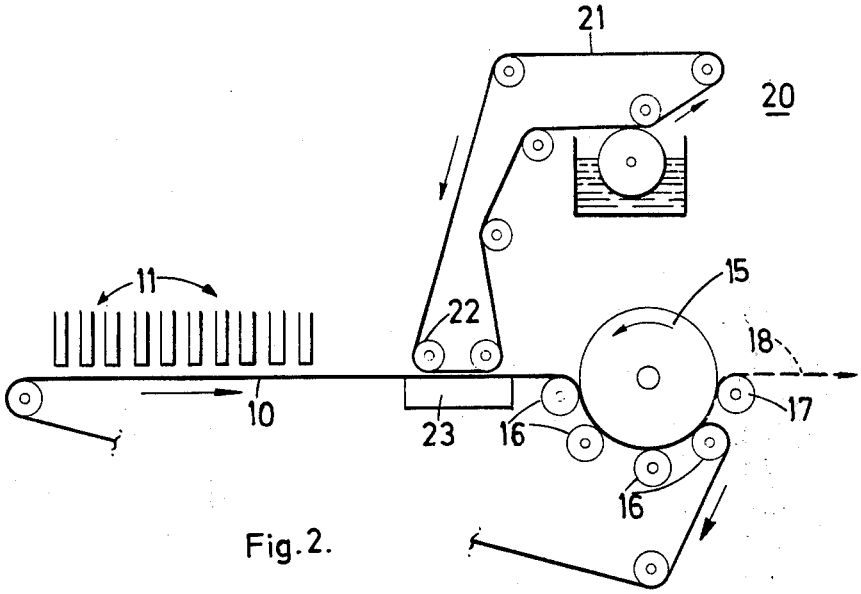

The invention is illustrated merely by way of example in the accompanying drawing in which FIG. 1 and 2 illustrate diagrammatically two embodiments of apparatus according to the present invention.

Referring to FIG. 1 there is shown an endless wire 10 being the main forming wire of the forming device illustrated. Disposed above the forming wire 10 are ten dispansing heads 11 through which dry fibres e.g, of cellulose mixed with 5% by weight of starch binder by an air distribution system (not shown) are conveyed in an air stream onto the upper surface of the wire 10 to form a fibrous mat thereon. A pressure nip 12 applies light pressure to the fibrous mat to compact it.

A heat box 13 having a slice 14 is mounted directly above the wire 10 and projects onto the upper surface of the fibrous mat a thin sheet of water or aqueous stock of high consistency. The moistened fibrous mat passes around a heated consolidating cylinder 15 and is pressed into contact therewith by four pressure rolls 16. A further pressure roll 17 which may also be heated develops strength in the moistended fibrous mat. The consolidated web 18 passes onto surface finishing and sizing stations as required in the finished product.

The hot moist pressing is preferably effected at a pressure of not less than 50 p.s.i., and preferably not less than 100 p.s.i., at a temperature greater than 150° F, preferably greater than 200° F. In a preferred process the pressure is of the order of 200 p.s.i. and the temperature of the order of 250° F.

The process may comprise laying dry fibres with between 1% and 8% by weight of binder, moistening to a moisture content of not more than 50% and hot moist pressing this mixture in the way set forth above.

Preferably the binder is between 2% and 6% by weight and the mixture is moistened to a moisture content of 35% - 45%. In a preferred embodiment the moisture content is kept below 40%.

In a typical installation the heads 11 will be depositing 200 gsm of fibre mixed with 5% starch and the water issuing from the slice 14 will provide in the mat a moisture content of the order of 30%. The cylinder 15 may have a surface temperature of the order of 240° F and the pressure rolls 16 may each be applied with the pressure of the order of 250 lbs per inch. The pressure roll 17 may be applied with even higher pressure and at an even higher temperature.

Where the slice 14 is used for issuing fibrous stock onto the fibrous mat a consistency of the order of 10 or 15% is preferred but with the present headboxes and slices available a consistency of the order of 3 or 4% may well be the best available.

A device for employing a high consistency stock of the order of 15% solid content is achieved with the device of FIG. 2. In this device a similar main forming wire 10 and consolidating cylinder 15 are employed and similar fibre distributing heads 11 are used. However to add the wet fibrous stock to the dry fibrous mat upon wire 10 a cylinder mould device 20 is employed to form upon an auxiliary forming wire 21 a wet-laid fibrous web which is transferred at roll 22 onto the upper surface of the dry fibrous mat upon the wire 10 with the aid of a vacuum box 23.

In a typical installation the ten dispensing heads 11 may each lay fibres at 20 gsm thereby adding 200 gsm web to the wire 10. The fibres are mixed with 5% starch and will have a moisture content of the order of 10% at this point. The cylinder mould device 20 will provide a fibrous mat of 15% solids content to achieve a 25 gsm final web. The wet web so laid upon wire 10 will have sufficient moisture to provide the mixed dry fibrous mat and wet laid web entering the consolidating section provided by cylinder 15 with a moisture content of the order of 35%.

The parameters for the consolidating section employing cylinder 15 and pressure nips 16, 17 can be the same as described with reference to FIG. 1 and set out in more detail in our co-pending United Kingdom application 32098/72 see U.S. application Ser. No. 375,094, now abandoned.

Rather than employ a cylinder mould device, other wet forming techniques may be employed e.g. suction formers, pressure formers or other high consistency forming. A Fourdrinier wire could be used.

Rather than laying the wet laid fibrous web onto the upper surface of the dry laid web, it is possible to lay the dry laid web onto the wet laid web by suitable change in machine configuration. However due to loss of water through the wire extra moisture content may be required in the wet laid web to allow for such losses.

In employing the device of FIG. 2 the stock will be beaten whereby the normal strength associated with wet-laid plies can be used. Furthermore sizing and surfacing agents may be added to the stock at the beater stage thus avoiding the need to apply sizing and surfacing agents on the consolidated web.

The wet-laid ply will form the liner for the finished board and will have the coventional strength and fold characteristics associated with wet-laid plies. These will be complementary to the bulk, dead fold moulding and nondirectional properties inherent on the dry-laid ply. Furthermore the techniques described above avoid the need for water sprays to add moisture to dry-laid fibrous mats which is a considerable problem in the dry-laying technique.

Where multi-ply products are required, two units of the type shown in FIG. 2 may be employed in back to back relationship whereby the wet-laid webs form the outer liners of the product and the dry-laid webs form the inner plies of the final product.

The invention is applicable to the manufacture of non-wovens i.e., drapes or textile-like materials as well as to paper or multi-ply paper board manufacture.

We claim:

1. A process for forming a multi-ply sheet of cellulosic fibrous material comprising the steps of:

dry-laying a mat of cellulosic fibrous material by depositing cellulosic fibers in a dry state via an airstream onto a main forming band to a thickness sufficient to form a distinct ply within a multi-ply sheet after the fibers of the mat have been caused to adhere together by the concurrent application of heat, moisture and pressure, forming a web of cellulosic fibrous material by a wet-forming technique on an auxiliary forming band, joining the web and the mat together under sufficient pressure to join them into a multi-ply sheet while concurrently consolidating the fibers of the dry-laid mat into a strong discernable ply by concurrently subjecting the mat to all three of moisture, heat greater than 150° F and pressure of not less than 50 p.s.i. by passing the joined multi-ply sheet through at least one press nip formed between at least one press roll and a heated cylinder wherein the dry-laid mat receives at least a major portion of the moisture it requires for such strength by transfer of moisture from the wet-laid web to the dry-laid mat.

2. A process according to claim 1, wherein the wet-formed web is formed with a moisture content sufficient to provide substantially all of the moisture required by the dry-laid fibrous mat during the consolidating step.

3. A process according to claim 1, wherein said pressure is repeatedly applied in a plurality of press nips formed between a plurality of press rolls and said heated cylinder.

4. A process according to claim 1, wherein the wet-formed web is formed using a cylindrical mold machine.

5. A process according to claim 1 wherein the heat is applied at a temperature of greater than 200° F.

6. An apparatus for forming a multi-ply sheet of cellulosic fibrous material comprising:

means for dry-laying a mat of cellulosic fibrous material including means for depositing cellulosic fibers in a dry state via an airstream onto a main forming band up to a thickness sufficient to form a distinct ply within a multi-ply sheet after the fibers of the mat have been caused to adhere together by the concurrent application of heat, moisture and pressure, an auxiliary forming band and means for forming a web of cellulosic fibrous material on said auxiliary forming band by a wet-forming process, means for joining the mat and the web together under sufficient pressure to join them into a multi-ply sheet, and means including at least one press roll and a heated cylinder forming at least one nip therebetween for consolidating the fibers of the dry-laid mat into a strong discernable ply by concurrently subjecting the mat to all three of moisture, heat greater than 150° F and pressure of not less than 50 p.s.i. while the joined mat and web pass through said nip, and wherein the moisture for such consolidation is provided from said wet-laid web.

7. Apparatus according to claim 6, wherein said wet-web forming means comprises a cylinder mold machine.

* * * * *